US007911690B2

(12) United States Patent
Chapman

(10) Patent No.: US 7,911,690 B2
(45) Date of Patent: Mar. 22, 2011

(54) FIREARM SIGHTING DEVICE FOR VIEWING AROUND OBSTACLES

(75) Inventor: Thomas Chapman, Canberra (AU)

(73) Assignee: The Commonwealth of Australia (AU)

( * ) Notice: Subject to any disclaimer, the term of this patent is extended or adjusted under 35 U.S.C. 154(b) by 688 days.

(21) Appl. No.: 10/595,879

(22) PCT Filed: Nov. 18, 2004

(86) PCT No.: PCT/AU2004/001590

§ 371 (c)(1),
(2), (4) Date: Feb. 16, 2007

(87) PCT Pub. No.: WO2005/050125

PCT Pub. Date: Jun. 2, 2005

(65) Prior Publication Data

US 2007/0279623 A1 Dec. 6, 2007

(30) Foreign Application Priority Data

Nov. 18, 2003 (AU) ..... 2003906341

(51) Int. Cl.
*G02B 23/08* (2006.01)

(52) U.S. Cl. ..... 359/402; 42/118; 42/148

(58) Field of Classification Search ..... 359/402–406; 42/118, 148

See application file for complete search history.

(56) References Cited

U.S. PATENT DOCUMENTS

| | | | | |
|---|---|---|---|---|
| 708,720 | A | 9/1902 | Konig | |
| 880,378 | A * | 2/1908 | Geis | 356/254 |
| 1,269,178 | A | 6/1918 | Hamilton | |
| 3,863,354 | A | 2/1975 | Karppinen | |
| 4,279,489 | A * | 7/1981 | Shono et al. | 396/384 |
| 5,054,225 | A * | 10/1991 | Giuffre et al. | 42/118 |
| 5,526,177 | A * | 6/1996 | Fantone | 359/402 |
| 6,311,424 | B1 * | 11/2001 | Burke | 42/118 |
| 6,604,316 | B1 | 8/2003 | Custer | |
| 6,643,969 | B1 | 11/2003 | Avizonis, Jr. | |
| 2005/0132631 | A1 * | 6/2005 | Bodo | 42/118 |
| 2005/0241210 | A1 * | 11/2005 | Karcher et al. | 42/119 |

* cited by examiner

*Primary Examiner* — Lee Fineman
(74) *Attorney, Agent, or Firm* — Akerman Senterfitt

(57) ABSTRACT

A viewing device (10) includes a body enclosing a first reflective surface or mirror (40), second reflective surface or mirror (42) and a mechanism for securing the body to a conventional sighting device or telescope (82) on a firearm. First mirror (40) is adapted to direct an incoming light beam (44) onto second mirror (42) so that an outgoing light beam (70) is angled relative to the incoming light beam (44). In use, viewing device (10) can be releasably attached to rear end (80) of telescope (82) and allows a user (90) to remain partially hidden behind obstacle (92) whilst viewing through sighting device (82) and using the firearm. The angular offset of respective light beams (44, 70) is between 35° and 60°.

23 Claims, 7 Drawing Sheets

FIREARM SIGHTING DEVICE FOR VIEWING AROUND OBSTACLES

BACKGROUND OF THE INVENTION

The present invention relates to the general art of fire-arms and sighting devices attached thereto, and more particularly to a sighting device for attachment to a weapon that facilitates viewing, especially viewing around obstacles.

Conventional weapon systems for rifles and so forth incorporate particular sighting arrangements that facilitate the targeting of the weapon at a particular object. Typically, the arrangement is that the user holds their weapon in the standard firing position and sights from directly behind and in line with the barrel of the weapon. This then requires that the user place themselves in a position that allows them to sight and discharge the weapon. This requires that the user align the sighting device that is attached to the weapon and their neck, head and eye, so that the object that is targeted is in focus and positioned in the cross-hairs (reticle). As such, the user may have to assume a position that will expose a portion of their body within the line of sight of an opponent and therefore putting themselves in considerable danger.

The dangers are indeed magnified in what is known as "urban" operations, and especially urban conflict or urban warfare, the terrain of which is quite different in that engagements are fought at relatively short range and many obstacles such as buildings and other large structures, prohibit clear viewing.

Indeed, it is perhaps buildings themselves that pose the biggest threat to safety in combat situations in that it is not possible to see what may be around the corner without first exposing ones self to what may be considerable danger.

One such way to overcome this has been to provide a mirror, or other such reflective service attached to either the end of the weapon, such as a rifle, or at the end of a telescopic rod. The problem with these types of devices is that they do not allow for simultaneous viewing and discharge of the weapon around the corner and further that these devices are cumbersome and indeed sometimes quite fragile due to the nature of materials used.

Other attempts to overcome the problem of inadvertently exposing the user to unseen dangers has been to provide a telescope so that a user may see a over an obstacle. Such telescopes have been known for some time, in relation to the starting and discharging of a weapon from a bunker. Typically, the viewing section of the telescope is substantially below the trigger mechanism, and the weapon is not supported by the user. An example of such periscopes is provided in U.S. Pat. No. 694,904, and is incorporated here by reference as a mere paper publication.

Typically, in such urban combat situations, conventional weapons are merely pointed around a corner so that the user does not expose themselves to the danger, and the weapon is discharged without any sighting of the target at all.

More recently, the advent of fibre optics and integrated imaging systems that have the ability to be attached to a weapon, allow the user to remain, for the most part, behind the obstacle in question when viewing around a corner. However, such viewing systems are relatively complex and expensive. They also require, in many instances, a power source so that they may operate, which adds further to the weight of the device. Additionally, various cords are required to connect the power source to the video unit and then back to the user, which results in a cumbersome arrangement. Due to these problems, only a small number of people may ultimately be issued such equipment, which itself poses many problems in terms of redundancy or back-up.

Accordingly, despite the significant attempts to overcome the problems as identified, there still remain significant problems in relation to the sighting of a weapon around an obstacle as well as the successful discharge of said weapon.

However, we have discovered that it is indeed possible to construct a sighting mechanism that allows the user to remain relatively well hidden behind an obstacle and allow the user to adopt a relatively stable stance or position from which to discharge the weapon with improved accuracy.

SUMMARY OF THE INVENTION

In one form of this invention, although this may not necessarily be the only or indeed the broadest form of this, there is proposed a viewing device that includes a main body, a first reflective surface, a second reflective surface, a means adapted for removably securing said body to a sighting device, wherein the first and second reflected surfaces are contained within the body, the first reflective surface adapted to direct an incoming light beam to the second reflective surface, wherein the first and second reflective surfaces are not positioned parallel to one another, and the second reflective surface adapted to direct the reflected light beam at an angle of between 35 degrees and 60 degrees relative to the incoming light beam.

In preference, the second reflective surface is positioned to direct the reflected light beam at an angle of between 40 and 55 degrees relative to the incoming light beam.

In preference, the second reflective surface is positioned to direct the reflected light beam at an angle of 50 degrees relative to the incoming light beam.

In preference, the second reflective surface is positioned at an angle of less than 90 degrees relative to a plane perpendicular to the incoming light beam.

In preference, the viewing device is removably secured to the rear eye piece of a conventional sighting device.

In preference, the viewing device is removably secured to the rear eye piece of a conventional sighting device by a friction fit.

In preference, the incoming light beam is directed to a side of the weapon.

In preference, the viewing device can be readily rotated about the sighting device, to direct the incoming light beam to either side of the weapon.

In preference, the first reflective surface and the second reflective surface are held in an anti-parallel arrangement relative to each other so that their reflective surfaces work in cooperation to redirect an incoming light beam.

In preference, the means adapted to removably secure the viewing device to a sighting device is a clip adapted to hold the viewing device with positive engagement to the sighting device.

In preference, the reflective surfaces are mirrors.

In preference, relay lenses are incorporated into the viewing device to provide eye relief.

In preference the viewing device is connected to a mounting member by a pivot means.

In preference, the pivot means is offset relative to a longitudinal axis of the sighting device.

In preference, the pivot means is integrated into the viewing device and the mounting member In preference, the mounting member is suitably adapted to releasably engage a rear eyepiece of a sighting device.

In preference, the engagement is by a friction fit.

In preference, the body of the viewing device is constructed from high impact resistant material.

In preference, the sighting device is a conventional rifle scope.

In preference, an imaging apparatus can be attached to the viewing device.

In preference, the imaging apparatus is a fibre optic cable.

In preference, the imaging apparatus is a device that generates video images.

BRIEF DESCRIPTION OF THE DRAWINGS

By way of illustration only, an embodiment of the invention is described more fully hereinafter with reference to the accompanying drawings, in which.

DETAILED DESCRIPTION

Figure 1:
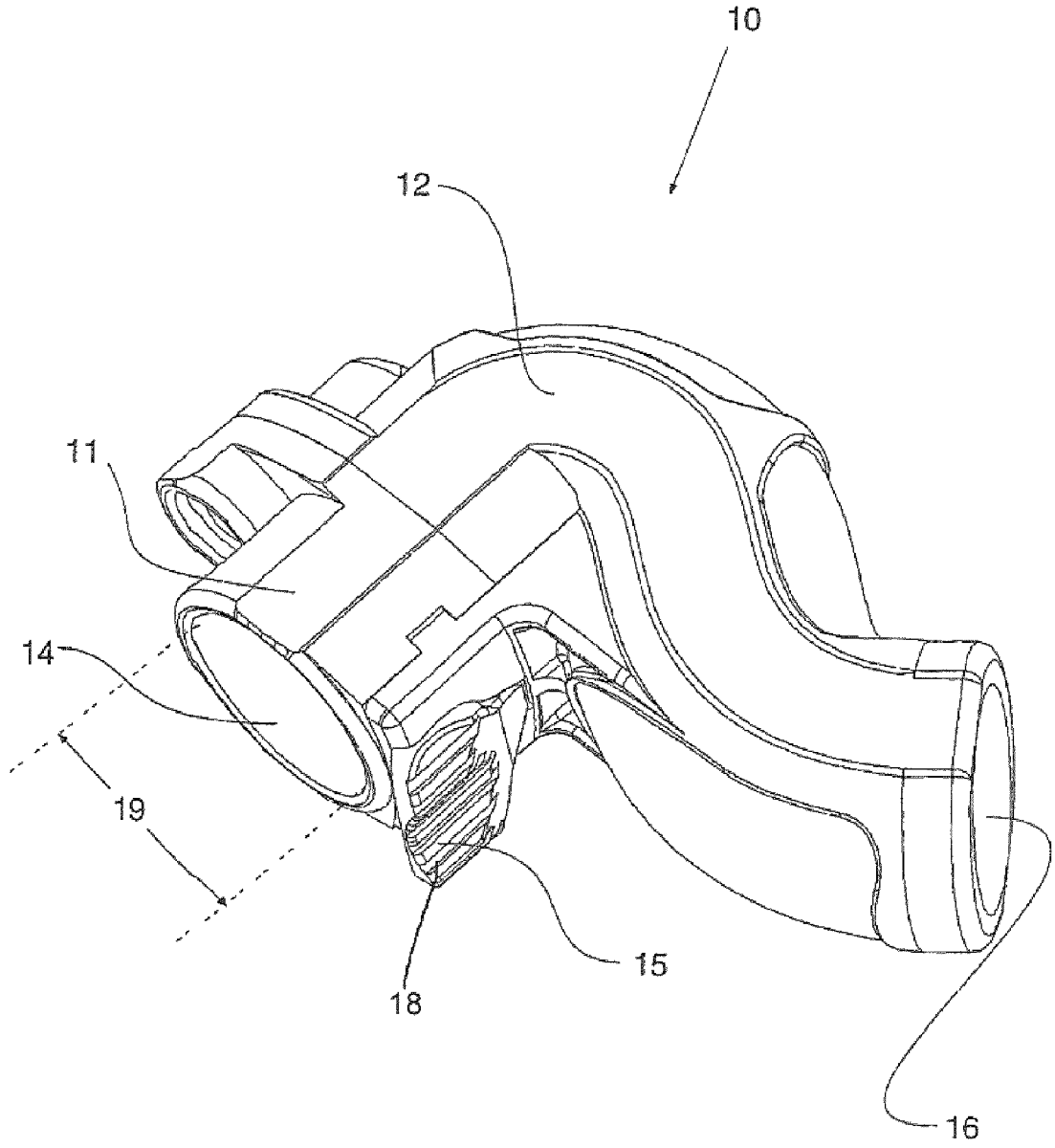
FIG. 1 is a perspective view of a viewing device according to a preferred embodiment of the invention.
Figure 2:
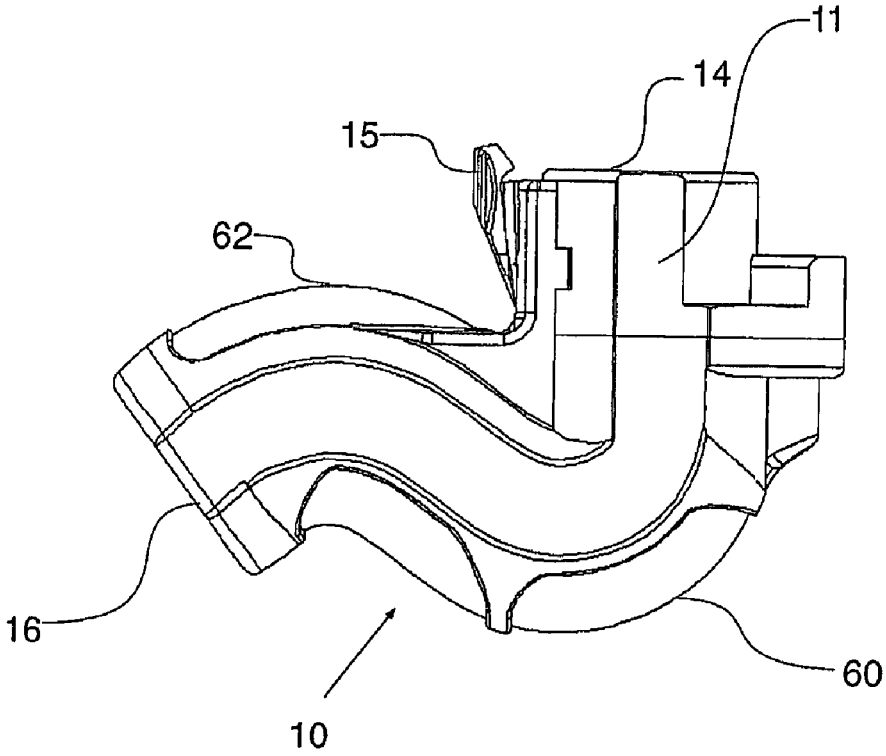
FIG. 2 is a top plan view of the device shown in FIG. 1.
Figure 3:
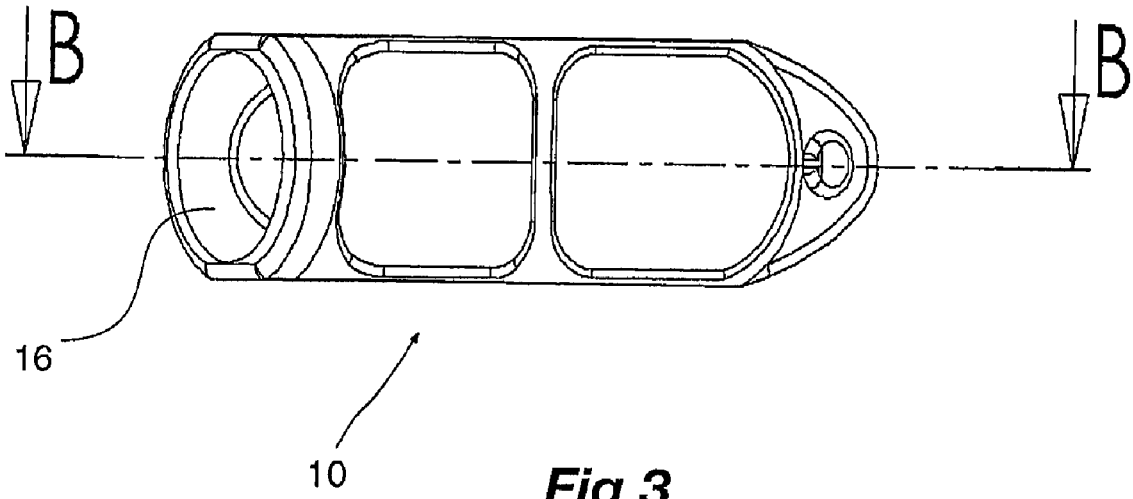
FIG. 3 is a rear view of the viewing device.

The viewing device 10 as shown in FIG. 1 has a body 12 and a mounting member 11 with an opening 14 with a diameter 19 sufficient to match the diameter of the scope or sighting device that the viewing device 10 is to attach to. There is also provided a viewing port 16 for a user to look through.

The diameter 19 may also be slightly larger than that of the scope so that the scope will nest within the opening 14 in a cooperative manner.

The body 12 has located near the opening 14 a catch means 15 designed to releasably inter-engage with a side the outer surface of the mounting member rim of a sight so as to captively hold the body 12 to the mounting member 11. The mounting member 11 engaging the eyepiece end of a conventional scope by a frictionally engaging nesting fit with sufficient force so that the mounting member 11 is not inadvertently dislodged from the scope or sighting device.

As would be well understood those skilled in this particular out, the viewing device 10 may also be adapted to the removably secured to a standard universal weapons mount such as a Picatinny weapon mount often referred to as a Picatinny rail). This then enables the attachment of any accessory for the weapon that utilizes the appropriate style of clamping device. Typically, universal weapon mounts, such as a Picatinny weapon mount, are attached near to the central midpoint of a weapon in order to provide a standard melting substrate to which various weapon accessories may be selectively attached.

The catch 15 has a grip texture 18 to facilitate purchase thereon. The catch 15 also has a portion 20 designed to interlock with an outer recess 23 on periphery of the mounting member 11.

Figure 4:
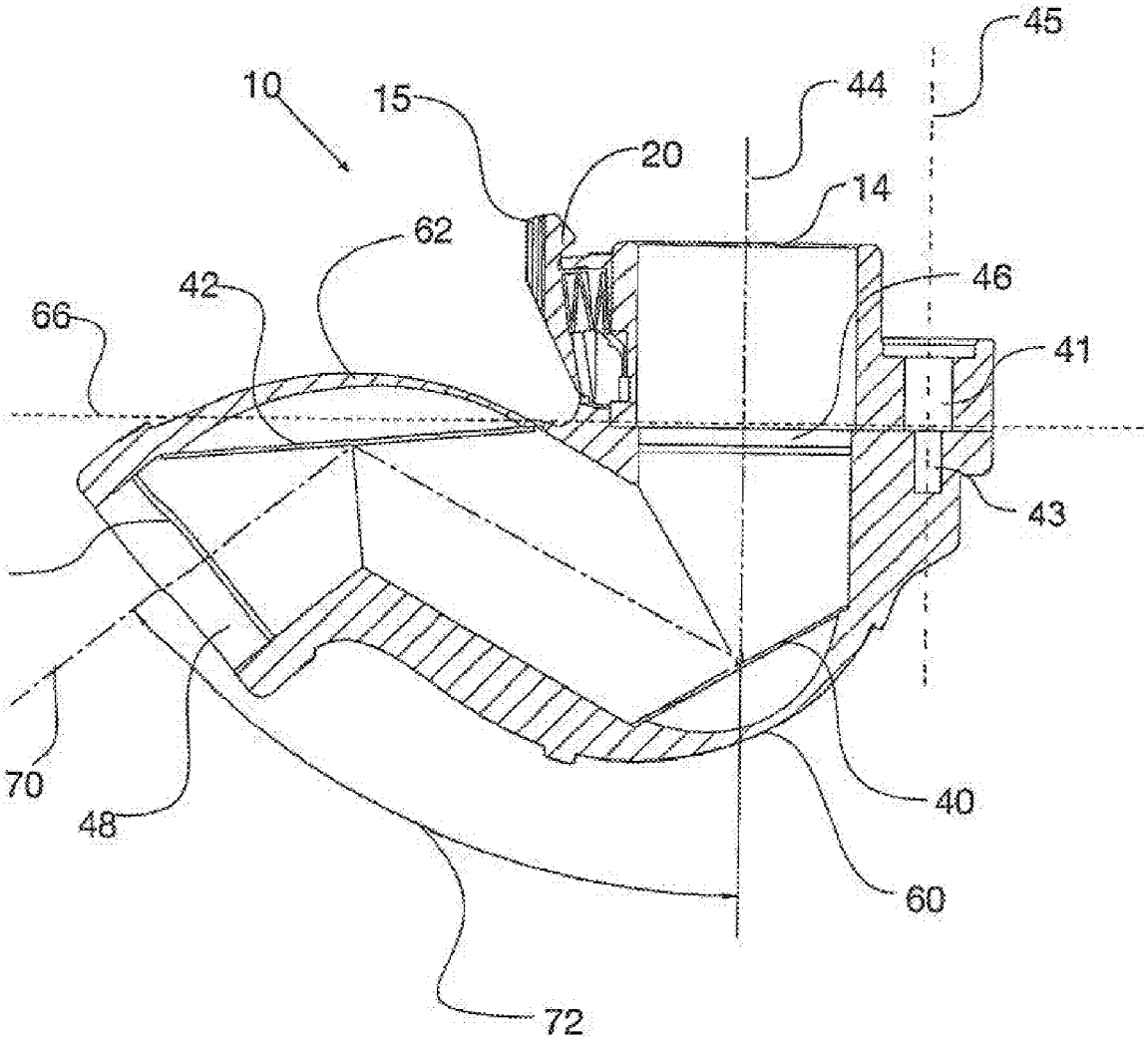
FIG. 4 is a plan sectional view through B-B in FIG. 3.

In FIG. 4, there is shown a cross-section of the viewing device 10 taken across B-B, showing the interior layout.

The mounting member 11 has an aperture 41, offset from. The aperture 41 is positioned in line with an aperture 43 on the body 12 to receive a pivotal fastening member such as a bolt or other suitable fastener to allow pivoting about axis 45, which is parallel to 44. The degree of allowable rotation about the pivot-fastening member is such that the body 12 will not interfere with the ejection port of the rifle and is different for each rifle.

There are several other ways that the mounting member 11 and the body 12 can be held in a pivotal relationship without departing from the scope of the invention, as would be known the skilled artisan.

FIG. 4 shows a first reflective surface 40 and a second reflective surface 42 in a non-parallel arrangement. Both opening 14 and opening 16 have nested within ocular lenses 46 and 48 respectively. The purpose of the ocular lenses 46 and 48 serves a purpose common to such lenses on fire-arm sighting scopes. It is clear that these lenses may be therefore adjustable to some degree to compensate for the individual user so as to provide the required amount of eye relief to provide accurate viewing.

The first reflective surface 40 is located at the first corner 60 of the body 12. The second reflective surface of 42 is positioned in the second corner 62. The first reflective surface 40 being positioned at an angle of approximately 45 degrees relative to plane 66.

The second reflective surface 42, being positioned in the second corner 62, is orientated at an angle of greater than 0 degrees relative to plane 66.

The incoming light beam 44 then extends through the opening 14 and subsequently, through the ocular lens 46 until it strikes the first reflective surface 40 and is reflected to the second reflective surface 42 where it is further reflected through the ocular lens 48 positioned within the opening 16 as the outgoing light beam 70.

The angle 72, which is the angle between the outgoing light beam 70 relative to the incoming light beam 44 is 50 degrees.

Figure 4A:
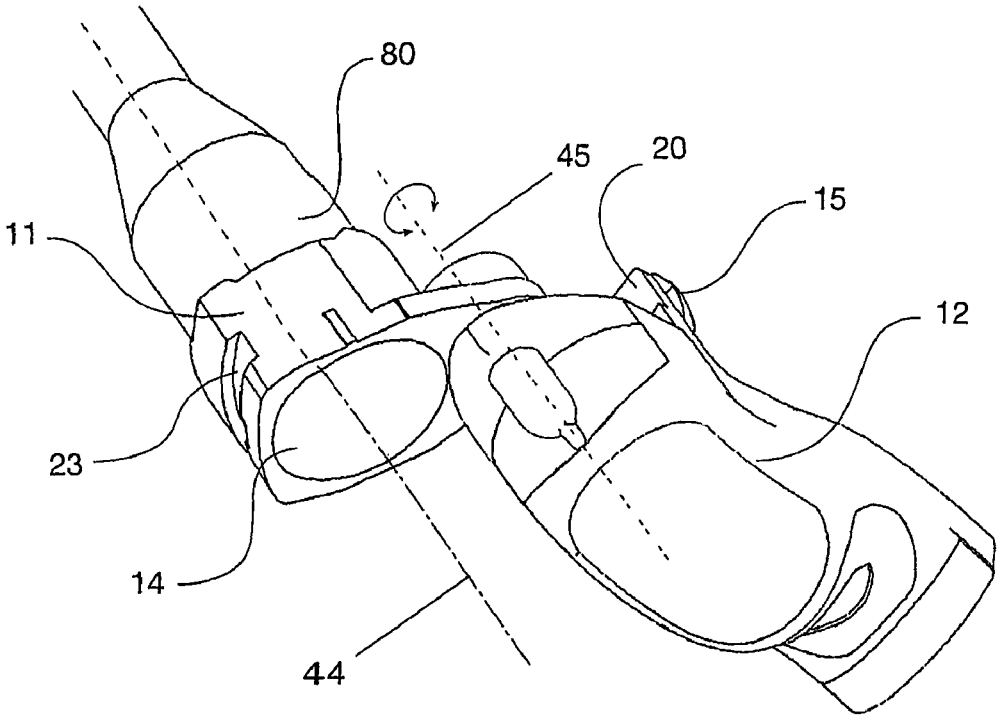
FIG. 4*a* is a perspective view of the viewing device connected to a mounting member in an open position.

In the open position, as shown in FIG. 4*a*, the body 12 pivots about the offset pivot point out of the way of the incoming light beam 44, while the mounting member 11 is retained on the eyepiece end 80 of a conventional scope 82.

Figure 5:
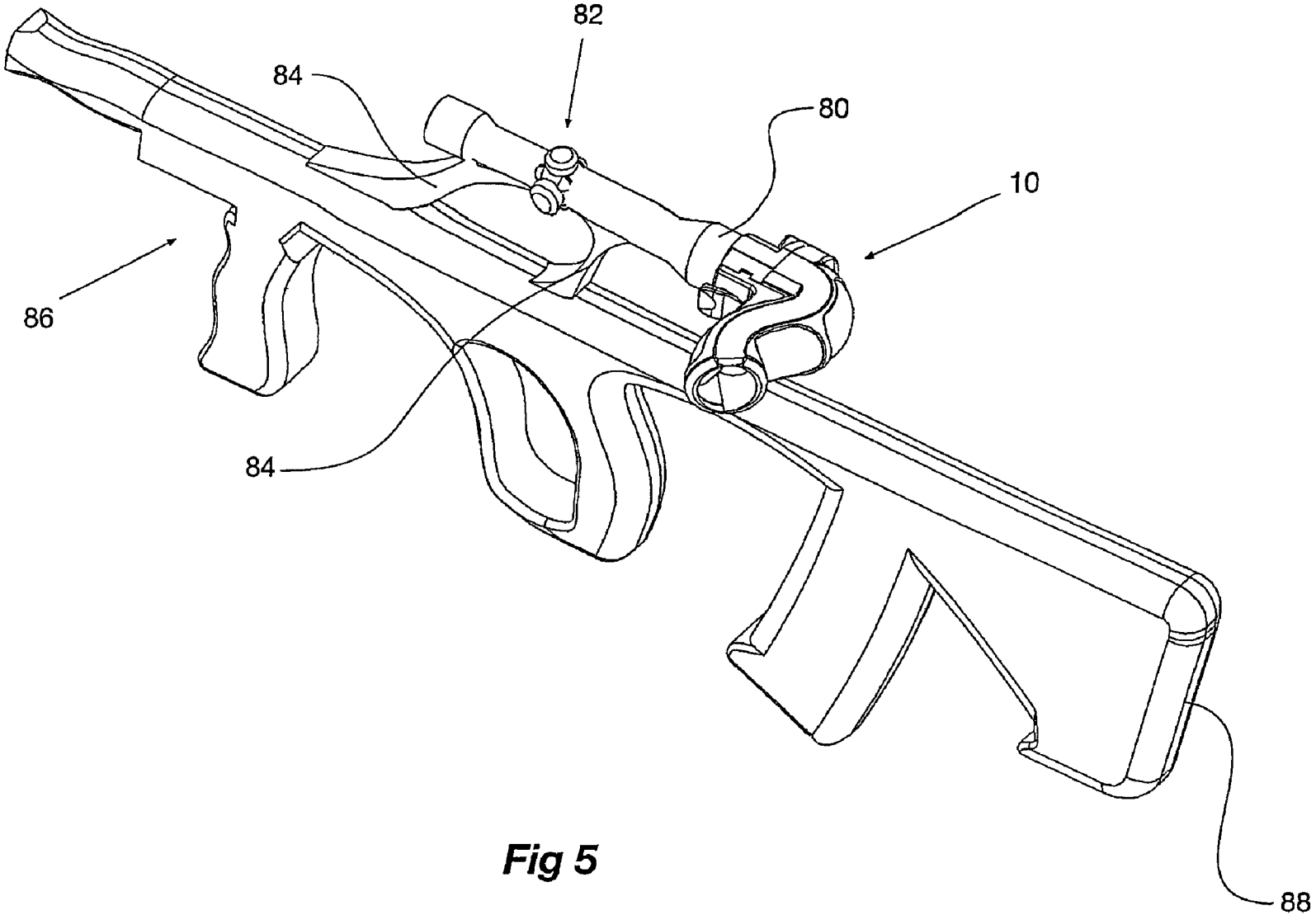
FIG. 5 is a perspective view of the viewing device in use when attached to a sighting device on a fire-arm.

FIG. 5 shows the viewing device 10 attached to the rear end 80 of a scope 82. The scope 82 is attached via a mount 84 positioned on a rifle 86.

The arrangement of the reflective surfaces 40 and 42 within the body 12 of the viewing device 10 as described above, allow for a user 90 to remain substantially hidden behind a corner 92 or other similar obstacle so as to allow the weapon to be discharged around the corner 92.

This arrangement also allows for greater effective control of the weapon 86 than if a single reflective surface positioned at 45 degrees relative to the incoming light beam 44, as in the present arrangement the butt 88 of the weapon 86 can be more securely held by the user 90 as this allows for a more natural firing position of the weapon 86 relative to the shoulder plane 94 of the user 90.

Additionally, the viewing device 10 provides for a greater scanning range of the target area as, due to the angle of the out going light beam 70, the user 90 has more room with which to move relative to the corner 92, than if they where at right angles to the incoming light beam 44.

Figure 6:
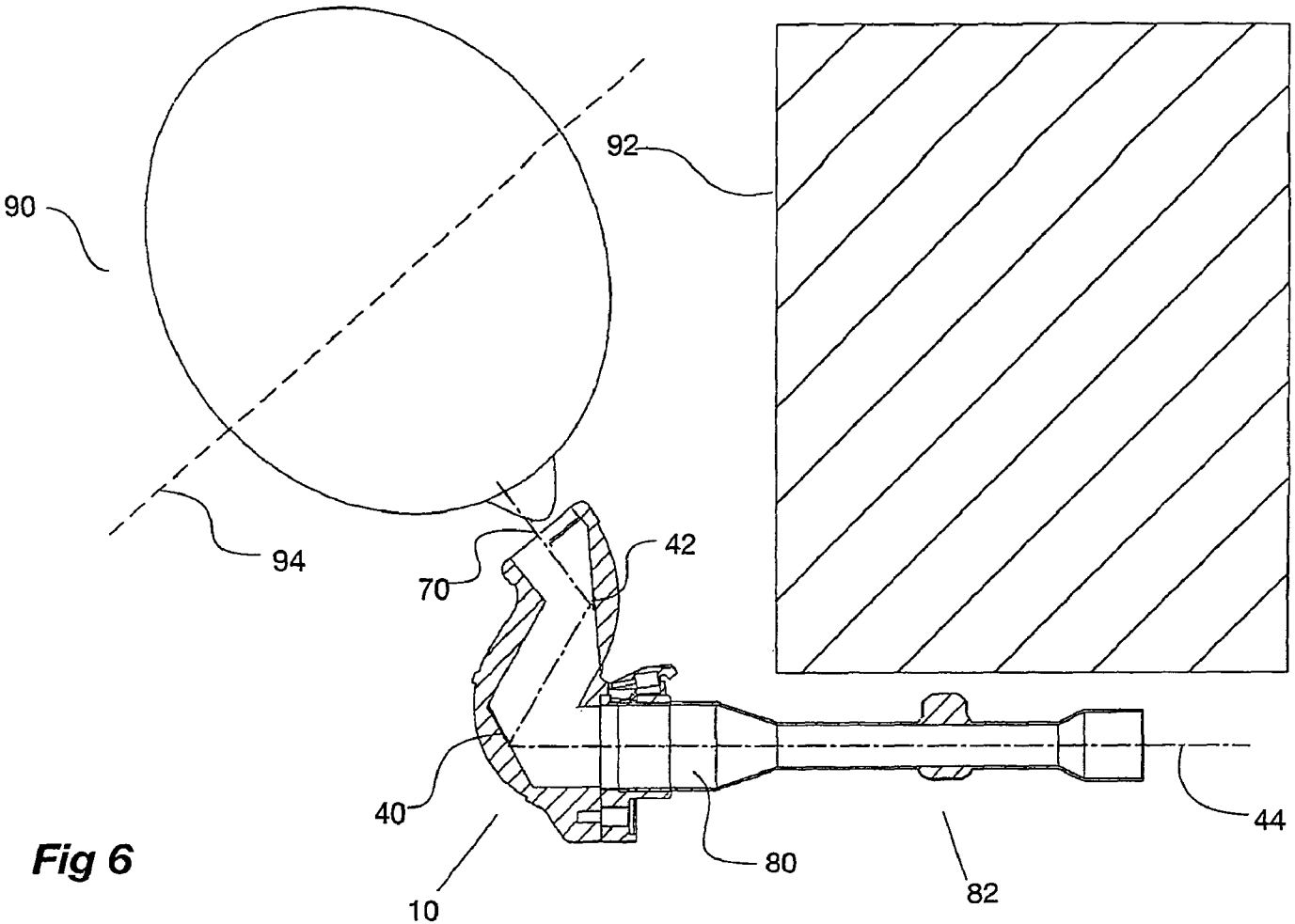
FIG. 6 is a plan view of the viewing device in use.
Figure 7:
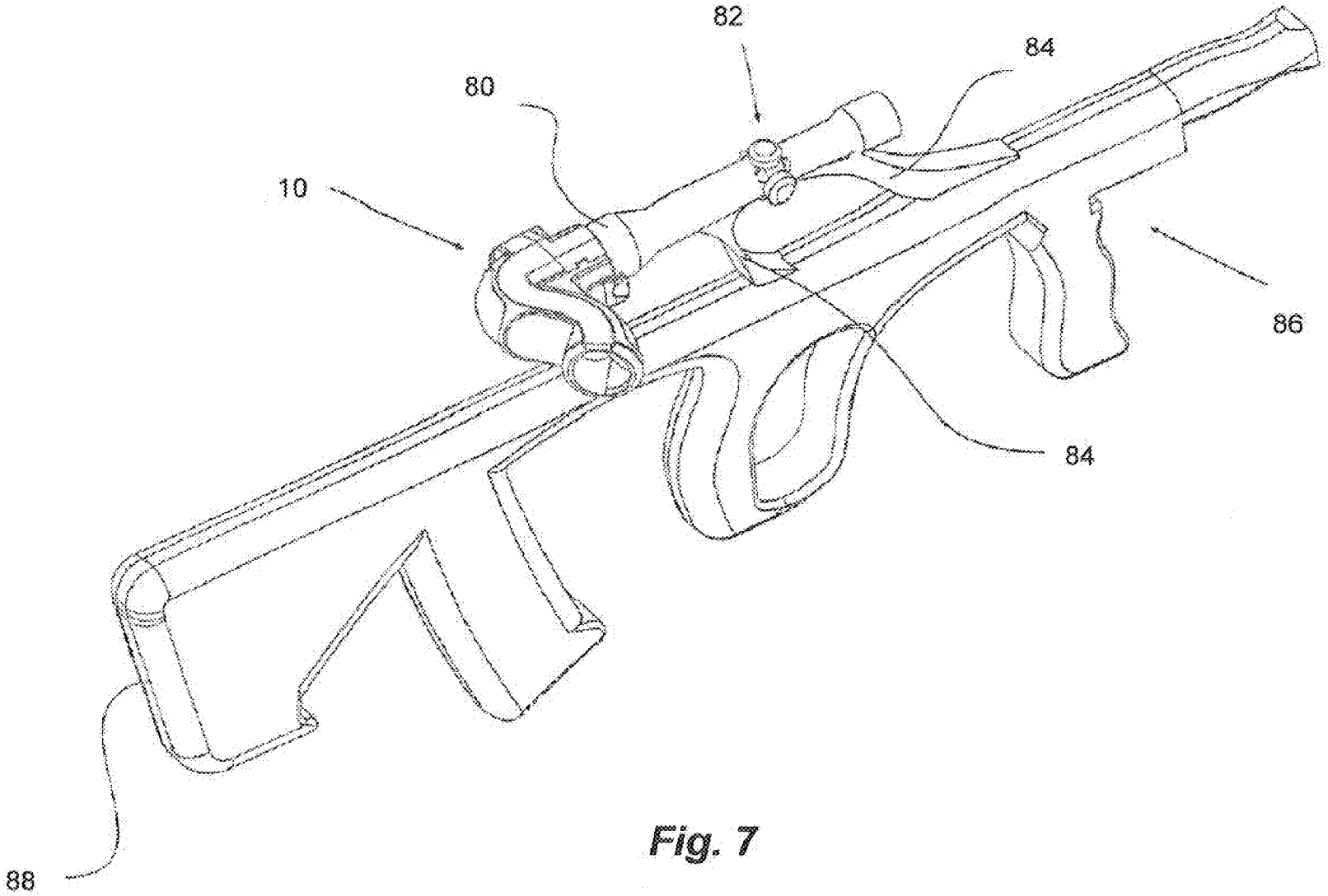
FIG. 7 is a perspective view of the viewing device in use when attached to a sighting device on a fire-arm.

Furthermore, the viewing device 10 can be readily rotated about the longitudinal axis of the incoming light beam 44 (as shown in FIG. 7) so that the user 90 may quickly adapt the viewing device 10 for use whilst they are positioned on the opposite side of the weapon to that shown in FIGS. 5 and 6.

Although the invention has been described and shown in what is conceived to be the most practical embodiment it is clear that various modifications may be made in details of design and construction as well as parameters of operation without departing from the scope and ambit of the invention.

The invention claimed is:

1. A viewing device that includes a main body, a first reflective surface fixedly mounted and contained within the body, a second reflective surface fixedly mounted and contained within the body, a means adapted for removably securing said body to a sighting device, wherein the first reflective surface is adapted to direct an incoming light beam from a first aperture to the second reflective surface, wherein the first and second reflective surfaces are not positioned parallel to one another, and the second reflective surface is adapted to direct the reflected light beam so that in total it is deflected at an angle of between 35 degrees and 60 degrees in the horizontal plane from the direction of the incoming light beam through a second aperture, and wherein the incoming light beam and the reflected light beam do not cross over one another, such that a user can be horizontally offset from the incoming light beam for viewing an object through the viewing device.

2. The viewing device of claim 1, wherein the second reflective surface is positioned to direct the reflected light beam so that it is deflected at an angle of between 40 and 55 degrees from the direction of the incoming light beam.

3. The viewing device of claim 2, wherein the second reflective surface is positioned to direct the reflected light beam so that it is deflected at an angle of 50 degrees from the direction of the incoming light beam.

4. The viewing device of claim 3, wherein the second reflective surface is positioned at an angle of less than 90 degrees relative to a plane perpendicular to the incoming light beam.

5. The viewing device of claim 4, wherein the viewing device is removably secured to a rear eyepiece of a conventional sighting device.

6. The viewing device of claim 5, wherein the viewing device is removably secured to the rear eyepiece of a conventional sighting device by a friction fit.

7. The viewing device of claim 6, wherein the incoming light beam is directed to a side of a weapon on which the viewing device is mounted.

8. The viewing device of claim 7, wherein the viewing device can be readily rotated about the sighting device, to direct the incoming light beam to either side of the weapon.

9. The viewing device of claim 8, wherein the means adapted to removably secure the viewing device to a sighting device is a clip adapted to hold the viewing device with positive engagement to the sighting device.

10. The viewing device of claim 9, wherein the reflective surfaces are minors.

11. The viewing device of claim 10, wherein relay lenses are incorporated into the viewing device to provide eye relief.

12. The viewing device of claim 11, wherein the viewing device is connected to a mounting member by a pivot means.

13. The viewing device of claim 12, wherein the pivot means is offset relative to a longitudinal axis of the sighting device.

14. The viewing device of claim 13, wherein the pivot means is integrated into the viewing device and the mounting member.

15. The viewing device of claim 14, wherein the mounting member is adapted to releasably engage a rear eyepiece of a sighting device.

16. The viewing device of claim 15, wherein the engagement is by a friction fit.

17. The viewing device as in claim 1, wherein the body of the viewing device is constructed from high impact resistant material.

18. The viewing device of claim 17, wherein the sighting device is a conventional riflescope.

19. The viewing device of claim 18, wherein an imaging apparatus can be attached to a rear of the body to capture the reflected light path.

20. The viewing device of claim 19, wherein the imaging apparatus is a fibre optic cable.

21. The viewing device of claim 20, wherein the imaging apparatus is a device that generates video images.

22. A method of viewing around an obstacle including:

(a) providing a viewing device that includes a main body, a first reflective surface fixedly mounted and contained within the body, a second reflective surface fixedly mounted and contained within the body, a means adapted for removably securing said body to a sighting device, wherein the first reflective surface is adapted to direct an incoming light beam to the second reflective surface, wherein the first and second reflective surfaces are not positioned parallel to one another, and the second reflective surface is adapted to direct the reflected light beam so that in total it is deflected at an angle of between 35 degrees and 60 degrees in the horizontal plane from the direction of the incoming light beam, and wherein the incoming light beam and the reflected light beam do not cross over one another;

(b) mounting said viewing device onto a rear most section of the sighting device;

(c) then viewing the reflected light beam through a rear of the body such that a head of a user looking through the viewing device is not substantially inline in the horizontal plane with the incoming light beam.

23. A viewing device including a main body, a first reflective surface fixedly mounted and contained within the body, a second reflective surface fixedly mounted and contained within the body, a means adapted for removably securing said body to a sighting device, wherein the first reflective surface is adapted to direct an incoming light beam from a first aperture to the second reflective surface, wherein the first and second reflective surfaces are not positioned parallel to one another, and the second reflective surface is adapted to direct the reflected light beam so that in total it is deflected at an angle of between 35 degrees and 60 degrees in the horizontal plane from the direction of the incoming light beam through a second aperture, and wherein the incoming light beam and the reflected light beam do not cross over one another, for viewing by a user, wherein the viewing device is removably connected to a mounting member by a pivot means such that the viewing device can be mounted on a weapon and rotated about a sighting device of the weapon, to direct the incoming light beam to either side of the weapon.

* * * * *